US012637747B2

(12) United States Patent
Mun et al.

(10) Patent No.: US 12,637,747 B2
(45) Date of Patent: May 26, 2026

(54) NON-HEAT TREATED WIRE ROD WITH EXCELLENT WIRE DRAWABILITY AND IMPACT TOUGHNESS AND MANUFACTURING METHOD THEREFOR

(71) Applicant: POSCO, Pohang-si (KR)

(72) Inventors: Dong Jun Mun, Pohang-si (KR); In-Gyu Park, Pohang-si (KR); Se Hong Min, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 539 days.

(21) Appl. No.: 17/615,739

(22) PCT Filed: Feb. 24, 2020

(86) PCT No.: PCT/KR2020/002630
§ 371 (c)(1),
(2) Date: Dec. 1, 2021

(87) PCT Pub. No.: WO2021/172604
PCT Pub. Date: Sep. 2, 2021

(65) Prior Publication Data

US 2022/0235443 A1 Jul. 28, 2022

(51) Int. Cl.
*C22C 38/38* (2006.01)
*C21D 8/06* (2006.01)
(Continued)

(52) U.S. Cl.
CPC ..... *C22C 38/38* (2013.01); *C21D 8/06* (2013.01); *C21D 9/525* (2013.01); *C22C 38/02* (2013.01);
(Continued)

(58) Field of Classification Search
None
See application file for complete search history.

(56) References Cited

U.S. PATENT DOCUMENTS 10,889,876 B2 1/2021 Mun et al.
10,988,821 B2 4/2021 Mun et al.
(Continued)

FOREIGN PATENT DOCUMENTS

CN 105671439 A 6/2016
CN 106350734 A 1/2017
(Continued)

OTHER PUBLICATIONS

Influence of Degree of Cold-Drawing on the Mechanical Properties of Low Carbon Steel (Year: 2011).*
(Continued)

*Primary Examiner* — Jenny R Wu
(74) *Attorney, Agent, or Firm* — Morgan Lewis & Bockius LLP

(57) ABSTRACT

Provided are a non-quenched and tempered wire rod having excellent drawability and impact toughness suitable for materials for automobiles or mechanical parts and a method of manufacturing the same. According to an embodiment of the present disclosure, the non-quenched and tempered wire rod includes, in percent by weight (wt %), 0.05 to 0.35% of carbon (C), 0.05 to 0.5% of silicon (Si), 0.5 to 2.0% of manganese (Mn), 1.0% or less of chromium (Cr), 0.03% or less of phosphorus (P), 0.03% or less of sulfur (S), 0.01 to 0.07% of soluble aluminum (sol.Al), 0.01% or less of nitrogen (N), at least one of 0.1% or less of niobium (Nb), 0.5% or less of vanadium (V), and 0.1% or less of titanium (Ti), and the remainder of iron (Fe) and inevitable impurities, and includes a ferrite-pearlite layered structure, as a microstructure, in a rolling direction.

5 Claims, 1 Drawing Sheet

(51) Int. Cl.

| | |
|---|---|
| ***C21D 9/52*** | (2006.01) |
| ***C22C 38/02*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |

(52) U.S. Cl.

CPC ..... *C22C 38/06* (2013.01); *C22C 38/22* (2013.01); *C22C 38/24* (2013.01); *C22C 38/26* (2013.01); *C21D 2211/005* (2013.01); *C21D 2211/009* (2013.01)

(56) References Cited

U.S. PATENT DOCUMENTS

| | | | | |
|---|---|---|---|---|
| 2018/0298464 | A1* | 10/2018 | Mun ..... | C21D 6/008 |
| 2018/0305787 | A1 | 10/2018 | Mun et al. | |

FOREIGN PATENT DOCUMENTS

| | | | | |
|---|---|---|---|---|
| CN | 108350548 | A | | 7/2018 |
| CN | 108350549 | A | | 7/2018 |
| JP | S5356120 | A | | 5/1978 |
| JP | S62-199750 | A | | 9/1987 |
| JP | H03-183739 | A | | 8/1991 |
| JP | H11-229090 | A | | 8/1999 |
| JP | 2003-113444 | A | | 4/2003 |
| JP | 2003-183733 | A | | 7/2003 |
| JP | 2004-060049 | A | | 2/2004 |
| JP | 2004-137542 | A | | 5/2004 |
| JP | 2017-043835 | A | | 3/2017 |
| JP | 2018-197375 | A | | 12/2018 |
| JP | 2018-537584 | A | | 12/2018 |
| JP | 2019-500489 | A | | 1/2019 |
| JP | 2019-502815 | A | | 1/2019 |
| KR | 10-2001-0060772 | A | | 7/2001 |
| KR | 10-2016-0068048 | A | | 6/2016 |
| KR | 10-2016-0068120 | A | | 6/2016 |
| KR | 20160068048 | A | * | 6/2016 |
| KR | 20160068120 | A | * | 6/2016 |
| KR | 10-2017-0056059 | A | | 5/2017 |
| KR | 10-2017-0072995 | A | | 6/2017 |
| KR | 10-2020-0062439 | A | | 6/2020 |

OTHER PUBLICATIONS

Japanese Office Action dated Jul. 4, 2023 issued in Japanese Patent Application No. 2021-574892 (with English translation).

Chinese Office Action dated Nov. 25, 2022 issued in Chinese Patent Application No. 202080043367.5 (with English translation).

Japanese Office Action dated Feb. 7, 2023 issued in Japanese Patent Application No. 2021-574892 (with English translation).

Japanese Office Action dated Dec. 19, 2024 issued in Japanese Patent Application No. 2021-574892 (English translation).

Extended European Search Report dated Mar. 1, 2023 issued in European Patent Application No. 20921609.2.

Communication dated Mar. 21, 2023 issued in European Patent Application No. 20921609.2.

International Search Report and Written Opinion dated Nov. 24, 2020 issued in International Patent Application No. PCT/KR2020/002630 (with English translation).

Korean Notice of Allowance dated May 6, 2020 issued in Korean Patent Application No. 10-2018-0147371.

Korean Office Action dated Dec. 20, 20219 issued in Korean Patent Application No. 10-2018-0147371.

* cited by examiner

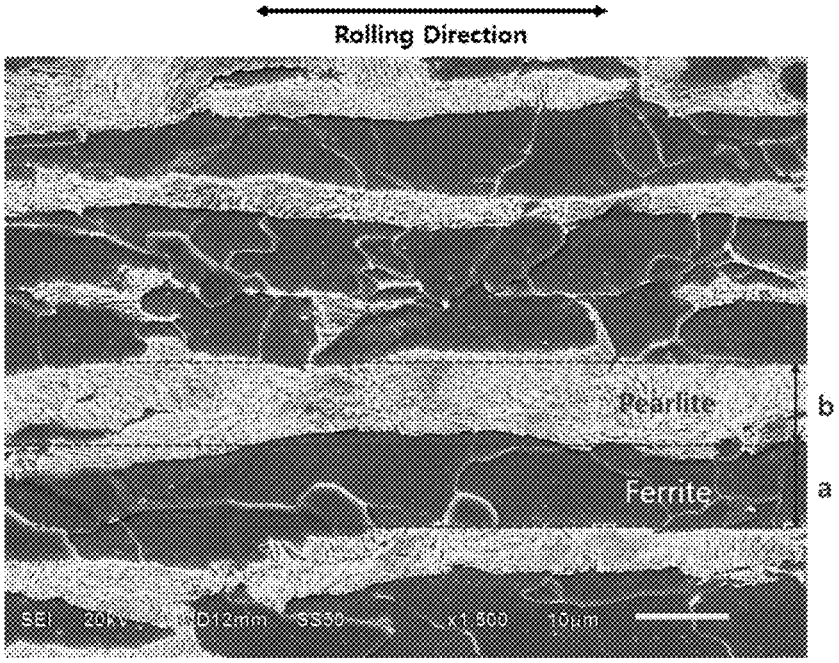
Rolling Direction
Pearlite
b
Ferrite
a
SEI 20kV x1,500 10μm

NON-HEAT TREATED WIRE ROD WITH EXCELLENT WIRE DRAWABILITY AND IMPACT TOUGHNESS AND MANUFACTURING METHOD THEREFOR

CROSS-REFERENCE OF RELATED APPLICATIONS

This application is the U.S. National Phase under 35 U.S.C. § 371 of International Patent Application No. PCT/KR2020/002630, filed on Feb. 24, 2020, the entire disclosure of which is incorporated by reference herein.

TECHNICAL FIELD

The present disclosure relates to a non-quenched and tempered wire rod and a method of manufacturing the same, and more particularly, to a non-quenched and tempered wire rod having excellent drawability and impact toughness suitable for materials for automobiles or mechanical parts and a method of manufacturing the same.

BACKGROUND ART

Most structural steels that have been used for mechanical structures or automobile parts are quenched and tempered steels having improved strength and toughness via reheating, quenching, and tempering processes after a hot process.

On the contrary, non-heat-treated steels are steels having similar strength to those of quenched and tempered steels, which are heat-treated, without undergoing heat treatment after hot working. Non-quenched and tempered wire rods have excellent economic feasibility by lowering manufacturing costs by omitting a heat treatment process involved in manufacturing processes of conventional quenched and tempered wire rods. Also, linearity of the non-quenched and tempered wire rods is maintained since heat treatment deflection, i.e., defect caused during heat treatment, is not generated by omitting final quenching and tempering steps. Thus, application of such non-quenched and tempered wire rods to various products has been attempted.

Particularly, ferritic-pearlitic non-quenched and tempered wire rods are advantageous in that components may be designed with low costs and a uniform structure may be stably obtained in a Stelmor cooling conveyer. However, as drawability increases, strength of products increases but problems of rapid decreases in ductility and toughness occur.

As a method to solve the above problems, a technique of obtaining a bainite-based microstructure using an expensive quenching element such as molybdenum (Mo) and boron (B) has been reported, but this technique is difficult to apply for commercial production due to deviation of physical properties caused by non-uniformity of the bainite structure by cooling deviation on the Stelmor cooling conveyer during manufacturing wire rods.

DISCLOSURE

Technical Problem

The present disclosure has been proposed to solve the above problems and an object of the present disclosure is to provide a non-quenched and tempered wire rod having excellent drawability and impact toughness without additional heat treatment and a method of manufacturing the same.

Technical Solution

One aspect of the present disclosure provides a non-quenched and tempered wire rod having excellent drawability and impact toughness including, in percent by weight (wt %), 0.05 to 0.35% of carbon (C), 0.05 to 0.5% of silicon (Si), 0.5 to 2.0% of manganese (Mn), 1.0% or less of chromium (Cr), 0.03% or less of phosphorus (P), 0.03% or less of sulfur (S), 0.01 to 0.07% of soluble aluminum (sol.Al), 0.01% or less of nitrogen (N), at least one of 0.1% or less of niobium (Nb), 0.5% or less of vanadium (V), and 0.1% or less of titanium (Ti), and the remainder of iron (Fe) and inevitable impurities; and a ferrite-pearlite layered structure, as a microstructure, in a rolling direction.

In addition, an average thickness of a ferrite band in an L cross-section, as a cross-section parallel to the rolling direction, may be from 5 μm to 30 μm.

In addition, an average particle diameter of the ferrite in a C cross-section, as a cross-section perpendicular to the rolling direction, may be from 3 μm to 20 μm.

In addition, a fraction of the ferrite may be from 30% to 90%.

In addition, an average lamellar space of the perlite may be from 0.03 μm to 0.3 μm.

In addition, a carbon equivalent Ceq represented by the following formula may be from 0.4 to 0.6:

$$Ceq = [C] + [Si]/9 + [Mn]/5 + [Cr]/12$$

(wherein [C], [Si], [Mn], and [Cr] are contents (%) of corresponding elements, respectively).

In addition, a difference between a maximum hardness and a minimum hardness in the C cross-section, as the cross-section perpendicular to the rolling direction, may be 30 Hv or less.

In addition, an average room temperature impact toughness may be 100 J or more in 30% to 60% drawing.

In addition, the wire rod may satisfy Equation (1) below in 30% to 60% drawing:

$$I\max - I\min \leq 40\ \text{J} \quad (1)$$

(wherein Imax is a maximum value of average room temperature impact toughness after drawing and Imin is a minimum value of average room temperature impact toughness after drawing).

Another aspect of the present disclosure provides a method of manufacturing a non-quenched and tempered wire rod having excellent drawability and impact toughness including: preparing a billet including, in percent by weight (wt %), 0.05 to 0.35% of carbon (C), 0.05 to 0.5% of silicon (Si), 0.5 to 2.0% of manganese (Mn), 1.0% or less of chromium (Cr), 0.03% or less of phosphorus (P), 0.03% or less of sulfur (S), 0.01 to 0.07% of soluble aluminum (sol.Al), 0.01% or less of nitrogen (N), at least one of 0.1% or less of niobium (Nb), 0.5% or less of vanadium (V), and 0.1% or less of titanium (Ti), and the remainder of iron (Fe) and inevitable impurities; reheating the billet at a reheating temperature Tr satisfying Equation (2) below; rolling the reheated billet into a wire rod; and coiling the rolled wire rod followed by cooling:

$$T1 \leq Tr \leq 1200^\circ \text{ C.} \quad (2)$$

(wherein T1=757+606[C]+80[Nb]/[C]+1023√[Nb]+330[V], and [C], [Nb], and [V] are contents (%) of corresponding elements, respectively).

In addition, the rolling of the reheated billet into the wire rod includes rolling the reheated billet at a final rolling temperature Tf satisfying Equation (3) below:

$$T2 \leq Tf \leq T3 \quad (3)$$

(wherein T2=955−396[C]+24.6[Si]−68.1[Mn]−24.8[Cr]−36.1[Nb]−20.7[V],

T3=734+465[C]−355[Si]+360[Al]+891[Ti]+6800[Nb]−650√[Nb]+730[V]−232√[V], and

[C], [Si], [Mn], [Cr], [Al], [Ti], [Nb], and [V] are contents (%) of corresponding elements, respectively).

In addition, the cooling includes cooling the wire rod at an average rate of 0.1° C./s to 2° C./s.

Advantageous Effects

According to an embodiment of the present disclosure, a non-quenched and tempered wire rod having excellent drawability and impact toughness prepared by controlling alloy compositions and manufacturing conditions without additional heat treatment and a method of manufacturing the same may be provided.

BEST MODE

A non-quenched and tempered wire rod having excellent drawability and impact toughness according to an embodiment of the present disclosure includes: in percent by weight (wt %), 0.05 to 0.35% of carbon (C), 0.05 to 0.5% of silicon (Si), 0.5 to 2.0% of manganese (Mn), 1.0% or less of chromium (Cr), 0.03% or less of phosphorus (P), 0.03% or less of sulfur (S), 0.01 to 0.07% of soluble aluminum (sol.Al), 0.01% or less of nitrogen (N), at least one of 0.1% or less of niobium (Nb), 0.5% or less of vanadium (V), and 0.1% or less of titanium (Ti), and the remainder of iron (Fe) and inevitable impurities, and has a ferrite-pearlite layered structure, as a microstructure, in a rolling direction.

DESCRIPTION OF DRAWINGS

FIG. 1 is a photograph of a ferrite-pearlite layered structure of a non-quenched and tempered wire rod according to an embodiment of the present disclosure.

MODES OF THE INVENTION

Hereinafter, embodiments of the present disclosure will be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the concept of the invention to those skilled in the art.

The terms used in the present specification are merely used to describe particular embodiments, and are not intended to limit the present disclosure. An expression used in the singular encompasses the expression of the plural, unless it has a clearly different meaning in the context. In the present specification, it is to be understood that the terms such as "comprise" or "include" are intended to indicate the existence of the features, operations, functions, components, or combinations thereof disclosed in the specification, and are not intended to preclude the possibility that one or more other features, operations, functions, components, or combinations thereof may exist or may be added.

The terms used in the present specification have the meaning commonly understood by one of ordinary skill in the art to which the present specification belongs. Terms commonly used should be interpreted in a consistent sense in the context of the present specification. Further, terms used in the present specification should not be interpreted in an idealistic or formal sense unless the meaning is clearly defined. An expression used in the singular encompasses the expression of the plural unless it has a clearly different meaning in the context.

Words of degree, such as "about," "substantially," and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

A non-quenched and tempered steel (non-heat-treated steel) refers to a steel having strength similar to that of a quenched and tempered steel that has been heat-treated, without heat treatment after hot working. Non-quenched and tempered wire rods have excellent economic feasibility by lowering manufacturing costs by omitting a heat treatment process involved in manufacturing processes of conventional quenched and tempered wire rods. Also, linearity of the non-quenched and tempered wire rods is maintained since heat treatment deflection, i.e., defect caused during heat treatment, is not generated by omitting final quenching and tempering steps. Thus, application of such non-quenched and tempered wire rods to various products has been attempted.

Particularly, ferritic-pearlitic non-quenched and tempered wire rods are advantageous in that components may be designed with low costs and a uniform structure may be stably obtained in a Stelmor cooling conveyer manufacturing process. However, as drawability increases, strength of products increases but problems of rapid decreases in ductility and toughness occur.

The present inventors have made intensive efforts, in many different ways, to provide a non-quenched and tempered wire rod having excellent drawability and impact toughness after drawing. As a result, the present inventors have found that increased strength may be obtained together with excellent impact toughness without additional heat treatment by appropriately adjusting the alloy compositions and the microstructure of the non-quenched and tempered wire rod, thereby completing the present disclosure.

A non-quenched and tempered wire rod having excellent drawability and impact toughness according to an aspect of the present disclosure includes in percent by weight (wt %), 0.05 to 0.35% of carbon (C), 0.05 to 0.5% of silicon (Si), 0.5 to 2.0% of manganese (Mn), 1.0% or less of chromium (Cr), 0.03% or less of phosphorus (P), 0.03% or less of sulfur (S), 0.01 to 0.07% of soluble aluminum (sol.Al), 0.01% or less of nitrogen (N), at least one of 0.1% or less of niobium (Nb), 0.5% or less of vanadium (V), and 0.1% or less of titanium (Ti), and the remainder of iron (Fe) and inevitable impurities.

Hereinafter, the reasons for limitation of the alloy composition of the non-quenched and tempered wire rod will be described in detail.

Carbon (C): 0.05 to 0.35 wt %

Carbon (C) plays a role in improving strength of a wire rod. The C content is preferably controlled to be 0.05 wt % or more to obtain such effects in the present disclosure. However, when the C content is excessive, deformation resistance of the steel rapidly increases, and thus cold processibility deteriorates thereby. Therefore, it is preferable to control an upper limit of the C content to be 0.35 wt %.

Silicon (Si): 0.05 to 0.5 wt %

Silicon is an effective element as a deoxidizer. The Si content is preferably controlled to 0.05 wt % or more to obtain such effects in the present disclosure. However, when the Si content is excessive, deformation resistance of a steel rapidly increases due to solid solution strengthening, and thus cold processibility deteriorates thereby. Therefore, an upper limit of the Si content is preferably 0.5 wt % and more preferably 0.25 wt %.

Manganese (Mn): 0.5 to 2.0 wt %

Manganese is an effective element as a deoxidizer and desulfurizer. The Mn content is preferably controlled to 0.5 wt % or more and more preferably 0.8 wt % or more to obtain such effects in the present disclosure. However, when the Mn content is excessive, strength of a steel increases too high and deformation resistance of the steel increases, thereby deteriorating cold processibility thereof. Therefore, an upper limit of the Mn content is preferably controlled to 2.0 wt % and more preferably 1.8 wt %.

Chromium (Cr): 1.0 wt % or less

Chromium plays a role in promoting transformation of ferrite and pearlite during hot rolling. Also, Cr contributes to reduction of a period of dynamic harmful effects caused by solid-solution carbon by decreasing the content of the solid-solution carbon by precipitating carbides in a steel without increasing strength of a steel more than necessary. However, when the Cr content is excessive, the strength of the steel increases too high and deformation resistance of the steel rapidly increases, thereby deteriorating cold processibilty thereof. Therefore, the Cr content is preferably 1.0 wt % and more preferably controlled to 0.5 wt %.

Phosphorus (P): 0.03 wt % or Less

Phosphorus, as an impurity inevitably contained in steels, is an element segregated in grain boundaries to decrease toughness of the steels and acts as a main cause of reducing delayed fraction resistance, and it is preferable to control the P content to be as low as possible. Although it is advantageous to control the P content to 0 wt % in theory, P is inevitably contained during a manufacturing process. Therefore, it is important to control an upper limit of the P content, and thus the upper limit of the P content is controlled to 0.03 wt % in the present disclosure.

Sulfur (S): 0.03 wt % or Less

Sulfur, as an impurity inevitably contained in steels, is an element segregated in grain boundaries to significantly decrease ductility of the steels and acting as a main cause of deteriorating delayed fraction resistance and stress relaxation properties by forming sulfides in the steels. Thus, it is preferable to control the S content to be as low as possible. Although it is preferable to control the S content to 0 wt % in theory, S is inevitably contained during a manufacturing process. Therefore, it is important to control an upper limit of the S content, and thus the upper limit of the S content is controlled to 0.03 wt % in the present disclosure.

Soluble Aluminum (Sol.Al): 0.01 to 0.07 wt %

Soluble aluminum is an element effectively acting as a deoxidizer. It is preferable that the sol.Al content is 0.01 wt % or more to obtain such effects in the present disclosure. The sol.Al content is more preferably 0.015 wt % or more and even more preferably 0.02 wt % or more. However, when the sol.Al content is excessive, particle diameter refinement effects of austenite increase due to formation of AlN, and thus cold forgeability thereof may deteriorate. Therefore, an upper limit of the sol.Al content is preferably 0.07 wt %.

Nitrogen (N): 0.01 wt % or Less

Nitrogen is an impurity inevitably contained in steels. When the N content is excessive, deformation resistance of a steel rapidly increases due to an increased content of solid-solution nitrogen and thus cold processibilty deteriorates thereby. Although it is preferable to control the N content to 0 wt % in theory, N is inevitably contained during a manufacturing process. Therefore, it is important to control an upper limit of the N content, and thus the upper limit of the N content is controlled preferably to 0.01 wt %, more preferably to 0.008 wt %, and even more preferably to 0.007 wt % in the present disclosure.

In addition, the wire rod according to the present disclosure may include the above-described components and at least one of niobium (Nb), vanadium (V) and titanium (Ti).

Niobium (Nb): 0.1 wt % or Less

Niobium is an element playing a role in limiting migration of grain boundaries of austenite and ferrite by forming a carbide and a carbonitride. However, when the Nb content is excessive, the carbonitride acts as a starting point of destruction, thereby deteriorating impact toughness and a problem of forming coarse precipitates may occur. Therefore, it is preferable to add niobium below a solubility limit. Therefore, an upper limit of the Nb content is preferably controlled to 0.1 wt %.

Vanadium (V): 0.5 wt % or Less

Vanadium, like niobium, plays a role in limiting migration of grain boundaries of austenite and ferrite by forming a carbide and a carbonitride. However, when the V content is excessive, the carbonitride acts as a starting point of destruction, thereby deteriorating impact toughness and a problem of forming coarse precipitates may occur. Therefore, it is preferable to add vanadium below a solubility limit. Therefore, an upper limit of the V content is preferably controlled to 0.5 wt %.

Titanium (Ti): 0.1 wt % or Less

Titanium also binds to carbon and nitrogen to form a carbonitride, thereby having an effect on limiting grain boundary size of austenite. However, when the Ti content is excessive, coarse precipitates are formed and the possibility of acting as a major crack generation site for destruction of inclusions increases. Therefore, an upper limit of titanium is preferably controlled to 0.1 wt %.

The remainder other than the above-described alloy elements is iron (Fe). In addition, the wire rod for drawing of the present disclosure may include other impurities that may be inevitably contained therein in general industrial manufacturing processes of steels. Since these impurities can be known to anyone skilled in the ordinary manufacturing process, types and contents thereof are not particularly limited in the present specification.

In the non-quenched and tempered wire rod according to an embodiment of the present disclosure, a carbon equivalent Ceq represented by the following formula may be from 0.4 to 0.6. When the carbon equivalent Ceq is less than 0.4, a target strength may be difficult to obtain. When the carbon equivalent is greater than 0.6, deformation resistance of a steel rapidly increases, thereby deteriorating cold processibility.

$$Ceq = [C] + [Si]/9 + [Mn]/5 + [Cr]/12$$

In this regard, [C], [Si], [Mn], and [Cr] are contents (%) of corresponding elements, respectively.

Hereinafter, a microstructure of the non-quenched and tempered wire rod according to the present disclosure will be described.

The non-quenched and tempered wire rod according to an embodiment of the present disclosure includes ferrite and pearlite as a microstructure. Referring to FIG. 1, the ferrite and pearlite may form a ferrite-pearlite layered structure (band structure). Also, the layered structure may be a ferrite-pearlite layered structure in a rolling direction according to an embodiment.

In this regard, the ferrite-pearlite layered structure in the rolling direction indicates that lengths and widths of a ferrite layer and a pearlite layer are formed in a direction parallel to the rolling direction and in a direction perpendicular to the rolling direction, respectively.

The ferrite-pearlite layered structure in the rolling direction has excellent drawability since an initial structure before drawing is aligned in a direction effective for drawing, and the ferrite-pearlite layered structure stretched in the rolling direction by drawing has improved impact toughness since an impact is difficult to propagate in the thickness direction and propagates along a ferrite-pearlite interface that is the weakest portion.

In addition, according to an embodiment, the non-quenched and tempered wire rod may include ferrite in an area fraction of 30 to 90%. When the wire rod has the structure as described above, excellent drawability and impact toughness may be obtained together with strength.

In the ferrite structure of the present disclosure, an average thickness of a ferrite layer (band) may be from 5 to 30 μm in an L cross-section that is a cross-section parallel to the rolling direction. In addition, an average particle diameter of the ferrite in a C cross-section that is a cross-section perpendicular to the rolling direction may be from 3 μm to 20 μm.

The thickness of the ferrite layer refers to a thickness of a ferrite band in the L cross-section that is a cross-section parallel to the rolling direction. When the average thickness of the ferrite band is less than 5 μm, strength increases, thereby deteriorating cold processibility. On the contrary, when the average thickness is greater than 30 μm, a target strength may be difficult to obtain.

A particle diameter of the ferrite refers to a particle diameter of ferrite in the C cross-section that is a cross-section perpendicular to the rolling direction. When the average particle diameter of the ferrite is less than 3 μm, strength increases due to grain boundary refinement and thus cold forgeability may decrease. On the contrary, when the average particle diameter is greater than 20 μm, a target strength may be difficult to obtain. In this regard, the average particle diameter refers to an average equivalent circular diameter detected by observing one cross-section of a steel sheet. Since an average particle diameter of pearlite formed therewith is affected by the average particle diameter of the ferrite, it is not particularly limited.

An average lamellar space of the pearlite structure of the present disclosure may be from 0.03 to 0.3 μm. As the lamellar space of the pearlite structure decrease, the strength of the wire rod increases. However, when the lamellar space is less than 0.03 μm, cold processibility may deteriorate. When the lamellar space is greater than 0.3 μm, a target strength may be difficult to obtain.

Hereinafter, the non-quenched and tempered wire rod having excellent drawability and impact toughness and including the above-described composition range and microstructure will be described.

According to an embodiment, a difference between a maximum hardness and a minimum hardness in the C cross-section, which is the cross-section perpendicular to the rolling direction, is 30 Hv or less.

According to another embodiment, an average room temperature impact toughness of the non-quenched and tempered wire rod is 100 J or more in 30% to 60% drawing.

According to another embodiment, the non-quenched and tempered wire rod satisfies Equation (1) below in 30 to 60% drawing.

$$I\max - I\min \leq 40\ \text{J} \quad (1)$$

Here, Imax is a maximum value of average room temperature impact toughness after drawing and Imin is a minimum value of average room temperature impact toughness after drawing.

In this regard, the room temperature impact toughness is evaluated by Charpy impact energy value obtained by performing a Charpy impact test on a specimen having a U-notch (U-notch standard sample, 10×10×55 mm) at 25° C.

Hereinafter, a method of manufacturing a wire rod according to an embodiment of the present disclosure will be described in detail.

The present inventors have found that both excellent drawability and impact toughness are obtained by forming a ferrite-pearlite layered structure (F-P band structure) well developed in the rolling direction through various experiments and proposed the present disclosure.

The method of manufacturing the non-quenched and tempered wire rod according to the present disclosure includes preparing a billet, reheating the billet at a reheating temperature, rolling the reheated billet into a wire rod, and coiling the rolled wire rod followed by cooling.

The billet prepared according to an embodiment of the present disclosure includes, in percent by weight (wt %), 0.05 to 0.35% of carbon (C), 0.05 to 0.5% of silicon (Si), 0.5 to 2.0% of manganese (Mn), 1.0% or less of chromium (Cr), 0.03% or less of phosphorus (P), 0.03% or less of sulfur (S), 0.01 to 0.07% of soluble aluminum (sol.Al), 0.01% or less of nitrogen (N), at least one of 0.1% or less of niobium (Nb), 0.5% or less of vanadium (V), and 0.1% or less of titanium (Ti), and the remainder of iron (Fe) and inevitable impurities.

Hereinafter, each step will be described in more detail.

Reheating Billet

In the step of reheating the billet, the billet having the above-described composition range may be reheated at a reheating temperature satisfying Equation (2) below.

$$T1 \leq Tr \leq 1200°\ \text{C.} \quad (2)$$

Here, $T1 = 757 + 606[C] + 80[Nb]/[C] + 1023\sqrt{[Nb]} + 330[V]$.

The step of reheating the billet at the reheating temperature Tr satisfying Equation (2) is a step for re-solid-solubilizing a carbonitride formed of Nb, V, or any combination thereof among the components in a base material. When the carbonitride formed of Nb, V, or any combination thereof remains in a heating furnace without being dissolved, continuous coarsening makes refinement of ferrite crystal grains difficult in a subsequent process of rolling the wire rod and a mixed grain structure may be formed during cooling.

In Equation (2) above, when the billet-reheating temperature is below T1, coarse carbonitrides formed of Nb, V, or any combination thereof cannot be completely re-solid-solubilized. When the reheating temperature for the billet exceeds 1200° C., an austenite structure excessively grows, thereby deteriorating ductility.

Rolling Reheated Billet into Wire Rod

The step of rolling the reheated billet into a wire rod may include hot rolling at a finish rolling temperature Tf satisfying Equation (3) below.

$$T2 \leq Tf \leq T3 \quad (3)$$

Here, $T2 = 955 - 396[C] + 24.6[Si] - 68.1[Mn] - 24.8[Cr] - 36.1[Nb] - 20.7[V]$, and $$T3 = 734 + 465[C] - 355[Si] + 360[Al] + 891[Ti] + 6800[Nb] - 650\sqrt{[Nb]} + 730[V] - 232\sqrt{[V]}.$$

Because the finish rolling temperature Tf affects a microstructure of an alloy, this is a very important process for forming a ferrite-pearlite layered structure. When a final rolling process is performed under the conditions satisfying Equation (3), the ferrite-pearlite layered structure is well formed.

When the finish rolling temperature Tf is below T2 in Equation (3), there is a possibility of deterioration in cold forgeability as deformation resistance caused by ferrite grain boundary refinement increases. When the finish rolling temperature Tf exceeds T3, the ferrite-pearlite layered structure may not be well formed.

Also, the rolling step at the finish rolling temperature may form fine ferrite and improve uniformity of ferrite distribution in the ferrite-pearlite layered structure by performing the rolling step at the finish rolling temperature Tf satisfying Equation (2) after the reheating step satisfying Equation (1) that is a pre-heating step.

Coiling Rolled Wire Rod Followed by Cooling

The step of coiling the rolled wire rod and cooling the resultant according to the present disclosure corresponds to a step of controlling lamellar spaces of pearlite in the ferrite-pearlite layered structure formed under the final rolling conditions in the previous process.

Basically, although pearlite is advantageous in terms of strength in a structure formed of ferrite and pearlite, it acts as a main factor for reducing toughness. In this case, a smaller lamellar space of pearlite is relatively advantageous to toughness.

Therefore, in the cooling step of the present disclosure, there is a need to appropriately control a cooling rate to decrease lamellar spaces of pearlite. When the cooling rate is too low, lamellar spaces may be widened raising a concern of decreasing ductility. When the cooling rate is too high, a low temperature structure is generated raising a concern of a rapid decrease in toughness.

In the present disclosure, an average cooling rate during cooling is preferably from 0.1 to 2° C./sec. When the average cooling rate is less than 0.1° C./sec, lamellar spaces of the pearlite structure may be widened raising a concern of decreasing ductility. When the average cooling rate exceeds 2° C./sec, a low temperature structure is generated raising concerns of an excessive increase in strength of the steel and a rapid decrease in toughness.

During cooling, the average cooling rate is more preferably from 0.3 to 1° C./sec. Within the ranges described above, a non-quenched and tempered wire rod having excellent ductility and toughness with sufficient strength may be obtained.

In the present disclosure as described above, the reheating temperature of the billet, the rolling temperature, and the subsequent cooling process are controlled to form the ferrite-pearlite layered structure. That is, the present disclosure is characterized in that the reheating, rolling, and cooling conditions are optimized in a series of processes consisting of reheating-rolling-cooling of the billet satisfying the above-described components.

Hereinafter, the present disclosure will be described in more detail through examples. However, it is necessary to note that the following examples are only intended to illustrate the present disclosure in more detail and are not intended to limit the scope of the present disclosure. This is because the scope of the present disclosure is determined by matters described in the claims and able to be reasonably inferred therefrom.

EXAMPLES

Billets having alloy compositions as shown in Table 1 below were heated for 3 hours at heating temperatures suitable for conditions of components, and then rolled to a wire diameter of 20 mm to prepare a wire rod. In this case, finish rolling temperatures were set in accordance with conditions for the components and the resultants were coiled and cooled at respective cooling rates.

Then, types and fractions of microstructures, thicknesses of ferrite bands, and lamellar spaces of pearlite were analyzed and measured by using an electron microscope, and the results are shown in Table 2 below.

Then, after 30 to 60% drawing, presence or absence of wire breakage, room temperature tensile strength, and room temperature impact toughness were measured, and the results are shown in Table 3 below. Drawability was indicated by ○ when wire breakage did not occur during drawing and indicated by X when wire breakage occurred once or more.

In this regard, the room temperature tensile strength was measured at the center of the non-heat-treated steel samples at 25° C., and the room temperature impact toughness was evaluated by Charpy impact energy value obtained by performing a Charpy impact test on a specimen having a U-notch (U-notch standard sample, 10×10×55 mm) at 25° C.

TABLE 1

| Steel type | Alloy composition (wt %) | | | | | | | | | | | |
|---|---|---|---|---|---|---|---|---|---|---|---|---|
| | C | Si | Mn | Cr | P | S | sol. Al | N | Nb | V | Ti | Ceq |
| Example 1 | 0.06 | 0.25 | 1.65 | 0.3 | 0.012 | 0.0052 | 0.034 | 0.0055 | 0.050 | 0.110 | 0 | 0.443 |
| Example 2 | 0.11 | 0.21 | 1.48 | 0 | 0.011 | 0.0043 | 0.041 | 0.0046 | 0.038 | 0.054 | 0 | 0.430 |
| Example 3 | 0.18 | 0.22 | 1.37 | 0 | 0.010 | 0.0038 | 0.030 | 0.0040 | 0.030 | 0.050 | 0 | 0.478 |
| Example 4 | 0.25 | 0.24 | 1.28 | 0.15 | 0.009 | 0.0046 | 0.026 | 0.0045 | 0.019 | 0 | 0 | 0.546 |
| Example 5 | 0.33 | 0.23 | 1.15 | 0 | 0.011 | 0.0050 | 0.032 | 0.0052 | 0.010 | 0 | 0.010 | 0.586 |
| Comparative Example 1 | 0.07 | 0.12 | 1.22 | 0.24 | 0.010 | 0.0062 | 0.031 | 0.0048 | 0.043 | 0.152 | 0 | 0.347 |
| Comparative Example 2 | 0.15 | 0.16 | 1.41 | 0.15 | 0.012 | 0.0055 | 0.035 | 0.0042 | 0.032 | 0.104 | 0 | 0.462 |
| Comparative Example 3 | 0.26 | 0.14 | 1.52 | 0.11 | 0.011 | 0.0043 | 0.042 | 0.0058 | 0.029 | 0.046 | 0 | 0.589 |
| Comparative Example 4 | 0.32 | 0.21 | 1.67 | 0 | 0.010 | 0.0051 | 0.033 | 0.0060 | 0.021 | 0.038 | 0 | 0.677 |
| Comparative Example 5 | 0.38 | 0.25 | 1.02 | 0 | 0.009 | 0.0047 | 0.024 | 0.0053 | 0.017 | 0 | 0.015 | 0.612 |
| Comparative Example 6 | 0.43 | 0.27 | 0.15 | 0 | 0.010 | 0.0056 | 0.027 | 0.0047 | 0.013 | 0 | 0 | 0.690 |

Here, Ceq = [C] + [Si]/9 + [Mn]/5 + [Cr]/12, and [C], [Si], [Mn], and [Cr] are contents (%) of corresponding elements, respectively.

TABLE 2

| Steel type | T1 (° C.) | Reheating temperature Tr (° C.) | T2 (° C.) | T3 (° C.) | Final rolling temperature Tf (° C.) | Average cooling rate (° C./s) | Structure | Ferrite fraction (%) | Average thickness of ferrite band in L cross-section (μm) | Average particle diameter of ferrite in C cross-section (μm) | Average lamellar space of pearlite (μm) | Hardness difference in C cross-section (Hv) |
|---|---|---|---|---|---|---|---|---|---|---|---|---|
| Example 1 | 1122 | 1156 | 814 | 880 | 834 | 1.6 | F + P | 84 | 23 | 15 | 0.26 | 9 |
| Example 2 | 1069 | 1085 | 813 | 841 | 828 | 1.1 | F + P | 77 | 22 | 12 | 0.24 | 15 |
| Example 3 | 1073 | 1097 | 794 | 826 | 815 | 0.8 | F + P | 69 | 17 | 7 | 0.25 | 20 |
| Example 4 | 1056 | 1073 | 770 | 813 | 806 | 0.4 | F + P | 56 | 15 | 8 | 0.20 | 18 |
| Example 5 | 1062 | 1082 | 751 | 829 | 789 | 1.0 | F + P | 42 | 10 | 11 | 0.16 | 26 |
| Comparative Example 1 | 1111 | 1135 | 836 | 914 | 812 | 1.3 | F + P | 82 | 32 | 12 | 0.30 | 32 |
| Comparative Example 2 | 1082 | 1104 | 796 | 862 | 887 | 0.9 | F + P | 71 | 36 | 25 | 0.28 | 26 |
| Comparative Example 3 | 1113 | 1065 | 747 | 891 | 834 | 0.08 | F + P | 53 | 19 | 14 | 0.34 | 19 |
| Comparative Example 4 | 1117 | 1087 | 718 | 851 | 856 | 2.4 | F + P | 35 | 31 | 18 | 0.21 | 28 |
| Comparative Example 5 | 1124 | 1132 | 741 | 875 | 862 | 0.05 | F + P | 28 | 26 | 22 | 0.32 | 36 |
| Comparative Example 6 | 1137 | 1154 | 713 | 862 | 841 | 1.2 | F + P | 21 | 24 | 16 | 0.27 | 41 |

Here, T1 = 757 + 606[C] + 80[Nb]/[C] + 1023√[Nb] + 330[V], T2 = 955 − 396[C] + 24.6[Si] − 68.1[Mn] − 24.8[Cr] − 36.1[Nb] − 20.7[V], T3 = 734 + 465[C] − 355[Si] + 360[Al] + 891[Ti] + 6800[Nb] − 650√[Nb] + 730[V] − 232√[V]

TABLE 3

| Sample No. | 0% drawing | | 35% drawing | | | 45% drawing | | | 55% drawing | | | |
|---|---|---|---|---|---|---|---|---|---|---|---|---|
| | Tensile strength (Mpa) | Impact toughness (J) | Tensile strength (Mpa) | Impact toughness (J) | Draw-ability | Tensile strength (Mpa) | Impact toughness (J) | Draw-ability | Tensile strength (Mpa) | Impact toughness (J) | Draw-ability | $I_{max} - I_{min}$ (J) |
| Example 1 | 546 | 345 | 738 | 253 | ○ | 781 | 221 | ○ | 824 | 224 | ○ | 32 |
| Example 2 | 574 | 316 | 771 | 219 | ○ | 813 | 210 | ○ | 857 | 216 | ○ | 9 |
| Example 3 | 621 | 256 | 822 | 209 | ○ | 870 | 206 | ○ | 909 | 190 | ○ | 19 |
| Example 4 | 613 | 211 | 840 | 188 | ○ | 887 | 179 | ○ | 933 | 168 | ○ | 20 |
| Example 5 | 642 | 185 | 867 | 164 | ○ | 908 | 153 | ○ | 958 | 162 | ○ | 11 |
| Comparative Example 1 | 617 | 225 | 807 | 168 | ○ | 845 | 135 | ○ | 889 | 103 | ○ | 65 |
| Comparative Example 2 | 625 | 212 | 826 | 151 | ○ | 873 | 116 | ○ | 924 | 97 | ○ | 54 |
| Comparative Example 3 | 689 | 156 | 908 | 102 | ○ | 953 | 88 | ○ | 997 | 61 | X | 41 |

TABLE 3-continued

| Sample No. | 0% drawing | | 35% drawing | | | 45% drawing | | | 55% drawing | | | |
|---|---|---|---|---|---|---|---|---|---|---|---|---|
| | Tensile strength (Mpa) | Impact toughness (J) | Tensile strength (Mpa) | Impact toughness (J) | Drawability | Tensile strength (Mpa) | Impact toughness (J) | Drawability | Tensile strength (Mpa) | Impact toughness (J) | Drawability | $I_{max} - I_{min}$ (J) |
| Comparative Example 4 | 696 | 143 | 927 | 94 | ○ | 979 | 74 | X | 1029 | 52 | X | 42 |
| Comparative Example 5 | 742 | 133 | 970 | 81 | ○ | 1022 | 62 | X | 1063 | 38 | X | 43 |
| Comparative Example 6 | 770 | 115 | 996 | 61 | X | 1041 | 43 | X | 1088 | 25 | X | 36 |

Here, $I_{max}$ is a maximum value of average room temperature impact toughness after drawing and $I_{min}$ is a minimum value of average room temperature impact toughness Hereinafter, based on Tables 1 to 3, samples of the examples and comparative examples were evaluated by comparison therebetween.

Referring to Tables 1 to 3, in the cases of Examples 1 to 5 satisfying the alloy compositions and manufacturing conditions of the present disclosure, excellent drawability and impact toughness with strength were obtained due to the ferrite-pearlite layered structure developed in the rolling direction.

On the contrary, in the cases of Comparative Examples 1 to 6 which do not satisfy the manufacturing conditions suggested by the present disclosure, the ferrite-pearlite layered structure could not be sufficiently formed in the rolling direction suggested by the present disclosure, occurrence rates of wire breakage were higher during drawing and impact toughness was lower compared to Examples 1 to 5.

In the case of Comparative Example 1, the carbon equivalent Ceq (0.347) was lower than 0.4 and the finish rolling temperature Tf was lower than T2. Thus, the average thickness (32 μm) of the ferrite band of the non-quenched and tempered wire rod of Comparative Example 1 in the L cross-section was greater than 30 μm, the hardness difference (32 Hv) in the C cross-section was greater than 30 Hv, and the difference (65 J) of the average room temperature impact toughness after 30 to 60% drawing was greater than 40 J, and thus the sample of Comparative Example 1 did not satisfy Equation (1) of the present disclosure.

In the case of Comparative Example 2, the final rolling temperature Tf exceeded T3. In addition, the average thickness (36 □m) of the ferrite band of the non-quenched and tempered wire rod of Comparative Example 2 in the L cross-section was greater than 30 □m, the average particle diameter (25 μm) of ferrite in the C cross-section was greater than 20 μm, the impact toughness (97 J) after 55% drawing was lower than 100 J, and the difference (54 J) between average room temperature impact toughness after 30 to 60% drawing was 40 J, and thus the sample of Comparative Example 2 did not satisfy Equation (1) of the present disclosure.

In the case of Comparative Example 3, the reheating temperature Tr exceeded T1 and the average cooling rate (0.08° C./s) was lower than 0.1° C./s. In addition, the average lamellar space (0.34 μm) of pearlite of the non-quenched and tempered wire rod of Comparative Example 3 was greater than 0.3 μm, impact toughness after 45% and 55% drawing were 88 J and 61 J, respectively, which were lower than 100 J, wire breakage occurred after 55% drawing, and the difference (41 J) between average room temperature impact toughness after 30 to 60% drawing was greater than 40 J, and thus the sample of Comparative Example 3 did not satisfy Equation (1) of the present disclosure.

In the case of Comparative Example 4, the carbon equivalent Ceq (0.677) was greater than 0.6, the reheating temperature Tr exceeded T1, the final rolling temperature Tf exceeded T3, and the average cooling rate (2.4° C./s) exceeded 2° C./s. In addition, the average thickness (31 μm) of the ferrite band in the L cross-section of Comparative Example 4 was greater than 30 μm, impact toughness after 35%, 45%, and 55% drawing was 94 J, 74 J, and 52 J which were lower than 100 J, wire breakage occurred after 45% and 55% drawing, and the difference (42 J) between average room temperature impact toughness after 30 to 60% drawing was greater than 40 J, and thus the non-quenched and tempered wire rod of Comparative Example 4 did not satisfy Equation (1) of the present disclosure In the case of Comparative Example 5, the C content (0.38 wt %) exceeded 0.35 wt %, the carbon equivalent Ceq (0.612) exceeded 0.6, and the average cooling rate (0.05° C./s) was lower than 0.1° C./s. In addition, the ferrite fraction (28%) was lower than 30%, the average particle diameter (22 μm) of ferrite in the C cross-section exceeded 20 μm, the average lamellar space (0.32 μm) of pearlite exceeded 0.3 μm, the hardness difference (36 Hv) in the C cross-section exceeded 30 Hv, impact toughness after 35%, 45, and 55% drawing was 81 J, 62 J, and 38 J, which were lower than 100 J, wire breakage occurred after 45% and 55% drawing, and the difference (43 J) of average room temperature impact toughness after 30 to 60% drawing was 40 J, and thus the non-quenched and tempered wire rod of Comparative Example 5 did not satisfy Equation (1) of the present disclosure.

In the case of Comparative Example 6, the C content (0.43 wt %) exceeded 0.35 wt % and the carbon equivalent Ceq (0.690) exceeded 0.6. In addition, the ferrite fraction (21%) was lower than 30%, the hardness difference (41 Hv) of the C cross-section exceeded 30 Hv, impact toughness after 35%, 45%, and 55% drawing was 61 J, 43 J, and 25 J, which were lower than 100 J, wire breakage occurred after 35%, 45%, and 55% drawing.

According to the non-quenched and tempered wire rod and the method of manufacturing the same according to the embodiments of the present disclosure, a non-quenched and tempered wire rod having excellent drawability and impact toughness may be provided without additional heat treatment by controlling alloy compositions and manufacturing conditions and a method of manufacturing the same may be provided.

While the present disclosure has been particularly described with reference to exemplary embodiments, it should be understood by those of skilled in the art that various changes in form and details may be made without departing from the spirit and scope of the present disclosure.

The invention claimed is:

1. A non-quenched and tempered wire rod comprising: in percent by weight (wt %), 0.05 to 0.35% of carbon (C), 0.05 to 0.5% of silicon (Si), 0.5 to 2.0% of manganese (Mn), 1.0% or less of chromium (Cr), 0.03% or less of phosphorus (P), 0.03% or less of sulfur(S), 0.01 to 0.07% of soluble aluminum (sol.Al), 0.01% or less of nitrogen (N), at least one of 0.1% or less of niobium (Nb), 0.5% or less of vanadium (V), and 0.1% or less of titanium (Ti), and the remainder of iron (Fe) and inevitable impurities; and a ferrite-pearlite layered structure, as a microstructure, in a rolling direction, wherein an average thickness of a ferrite band in an L cross-section, as a cross-section parallel to the rolling direction, is from 10 μm to 23 μm, wherein an average room temperature impact toughness is from 160 J to 253 J at 35% drawing, from 153 J to 221 J at 45% drawing, and from 162 J to 224 J at 55% drawing, wherein a difference between a maximum hardness and a minimum hardness in a C cross-section perpendicular to the rolling direction, is 30 Hv or less, wherein an average particle diameter of the ferrite in the C cross-section is from 3 μm to 20 μm, and wherein an average lamellar space of the pearlite is from 0.03 μm to 0.3 μm, wherein the wire rod satisfies $I_{max}-I_{min}<40$ J in 30% to 60% drawing, wherein $I_{max}$ is a maximum value of average room temperature impact toughness after drawing and $I_{min}$ is a minimum value of average room temperature impact toughness after drawing.

2. The non-quenched and tempered wire rod of claim 1, wherein a fraction of the ferrite is from 30% to 90%.

3. The non-quenched and tempered wire rod of claim 1, wherein a carbon equivalent $C_{eq}$ represented by the following formula is from 0.4 to 0.6:

$$Ceq = [C] + [Si]/9 + [Mn]/5 + [Cr]/12$$

(wherein [C], [Si], [Mn], and [Cr] are contents (wt %) of corresponding elements, respectively).

4. A method of manufacturing the non-quenched and tempered wire rod of claim 1, the method comprising: preparing a billet comprising, in percent by weight (wt %), 0.05 to 0.35% of carbon (C), 0.05 to 0.5% of silicon (Si), 0.5 to 2.0% of manganese (Mn), 1.0% or less of chromium (Cr), 0.03% or less of phosphorus (P), 0.03% or less of sulfur(S), 0.01 to 0.07% of soluble aluminum (sol.Al), 0.01% or less of nitrogen (N), at least one of 0.1% or less of niobium (Nb), 0.5% or less of vanadium (V), and 0.1% or less of titanium (Ti), and the remainder of iron (Fe) and inevitable impurities;

reheating the billet at a reheating temperature Tr satisfying Equation (2) below;

rolling the reheated billet into a wire rod; and coiling the rolled wire rod followed by cooling, and thereby producing the non-quenched and tempered wire rod of claim 1;

wherein the rolling of the reheated billet into the wire rod comprises rolling the reheated billet at a final rolling temperature Tf satisfying Equation (3) below, $$T1 \le Tr \le 1200°\,C. \quad (2)$$

$$T2 \le Tf \le T3 \quad (3)$$

(wherein $T1 = 757 + 606[C] + 80[Nb]/[C] + 1023\sqrt{[Nb]} + 330[V]$, $T2 = 955 - 396[C] + 24.6[Si] - 68.1[Mn] - 24.8[Cr] - 36.1[Nb] - 20.7[V]$, $T3 = 734 + 465[C] - 355[Si] + 360[Al] + 891[Ti] + 6800[Nb] - 650f[Nb] + 730[V] - 2321[V]$, and

[C], [Si], [Mn], [Cr], [Al], [Ti], [Nb], and [V] are contents (wt %) of corresponding elements, respectively).

5. The method of claim 4, wherein the cooling comprises cooling the wire rod at an average rate of 0.1° C./s to 2° C./s.

* * * * *